US006726182B2

(12) United States Patent
Topping, Jr. et al.

(10) Patent No.: US 6,726,182 B2
(45) Date of Patent: Apr. 27, 2004

(54) MANUAL WINCH WITH DUAL LOCKING DOGS

(75) Inventors: Richard A. Topping, Jr., Pittsburgh, PA (US); David B. Grapes, Pittsburgh, PA (US)

(73) Assignee: W. W. Patterson Company, Pittsburgh, PA (US)

( * ) Notice: Subject to any disclaimer, the term of this patent is extended or adjusted under 35 U.S.C. 154(b) by 0 days.

(21) Appl. No.: 10/051,630

(22) Filed: Jan. 17, 2002

(65) Prior Publication Data

US 2002/0166999 A1 Nov. 14, 2002

Related U.S. Application Data

(60) Provisional application No. 60/262,180, filed on Jan. 17, 2001.

(51) Int. Cl.[7] ..... B66D 5/02

(52) U.S. Cl. ..... 254/376; 254/321; 254/357; 74/505

(58) Field of Search ..... 254/376, 321; 74/505

(56) References Cited

U.S. PATENT DOCUMENTS

| | | | | | |
|---|---|---|---|---|---|
| 389,052 | A | * | 9/1888 | Brown | |
| 530,734 | A | * | 12/1894 | Towne | |
| 1,052,967 | A | * | 2/1913 | Rochambeau | |
| 1,286,762 | A | * | 12/1918 | Pehrson | |
| 1,522,249 | A | * | 1/1925 | Klasing | |
| 1,775,236 | A | * | 9/1930 | Corcoran | |
| 2,174,668 | A | * | 10/1939 | Naylor | |
| 2,269,438 | A | * | 1/1942 | Coffing | |
| 2,295,711 | A | * | 9/1942 | Breen | |
| 2,462,167 | A | * | 2/1949 | Dath | |
| 2,462,183 | A | * | 2/1949 | Haseltine | |
| 2,508,186 | A | * | 5/1950 | Newell | |
| 2,746,718 | A | * | 5/1956 | French | |
| 3,572,638 | A | * | 3/1971 | Tatsuguchi | 74/150 |
| 3,988,944 | A | * | 11/1976 | Klasing | 74/505 |
| 4,282,771 | A | * | 8/1981 | Grube | 74/505 |
| 4,511,123 | A | * | 4/1985 | Ostrobrod | 254/364 |

FOREIGN PATENT DOCUMENTS

| | | | |
|---|---|---|---|
| GB | 2024759 | * | 1/1980 |
| SU | 1698178 | * | 12/1991 |

OTHER PUBLICATIONS

Yoke Industrial Corporation advertisement for "Cargo Controlled System"; Oct. 1, 1997; 2 pgs.
Fuji Seiko advertisement for "Fuji Manual Winch"; 8 pgs.
Blackburn Marine, Inc. advertisement for "Barge Connector Winch"; 3 pgs.
Wintech International, Inc. advertisement for "Handi–Winch®"; 11 pgs.
Wintech International, Inc. advertisement for "Operation and Maintenance Manual for Hand Winch Models"; Nov. 1999; 6 pgs.

* cited by examiner

*Primary Examiner*—Thomas J. Brahan
(74) *Attorney, Agent, or Firm*—BLK Law Group; Blynn L. Shideler; Krisanne Shideler

(57) ABSTRACT

A manual winch with dual locking dogs is designed to be easily retrofitted into existing winches. The design of the winch includes a housing supporting a rotatable drum upon which the cable is reeved. A pair of gears are attached to the drum with locking dogs that may be independently engaged with each gear, wherein the drum is prevented from unwinding with at least one locking dog engaged with a respective gear.

13 Claims, 12 Drawing Sheets

MANUAL WINCH WITH DUAL LOCKING DOGS

CROSS-REFERENCE TO RELATED APPLICATION

This application claims the benefit of U.S. Provisional Patent Application Ser. No. 60/262,180, filed Jan. 17, 2001 entitled "Manual Winch With Dual Locking Dogs", which is incorporated herein by reference.

BACKGROUND OF THE INVENTION

1. Field of the Invention

The present invention relates to a manual winch with a safe release mechanism, more particularly, the present invention relates to a manual winch with dual locking dogs and a method of retrofitting existing winches.

2. Prior Art

Winches are commonly used for winding and reeling cable and rope for lifting, pulling, towing, guiding and the like of any number of objects. A wide variety of powered and manual winches have been developed. Manual winches remain in common use where a powered winch would be impractical or inefficient. Even in a manual winch the operator, through various mechanical advantages, can generate a very large tension on the cable. Such high load manual winches are common in marine environments for towing barges and the like. Examples of manual winches are described in greater detail in U.S. Patent No. 5,947,450 which is incorporated herein by reference.

In a high load manual winch there is some concern to the operator in releasing the load and unwinding the reel, also called a drum. The high load manual winch will have some type of locking mechanism to hold the load and prevent the drum from unwinding. One typical locking mechanism is a pawl, also called a locking dog, which is engaged with a gear to prevent the gear and the associated drum from unwinding. Consequently, an engaged locking dog is essentially receiving the load of the cable through the drum and the associated gear. In one conventional design, a loading or actuating lever is coupled to the gear through further gearing for winding and unwinding, also called loading and unloading, of the drum and the locking dog. It is common for an operator to use an extension to the loading lever to increase the mechanical advantage provided. In the unwinding operation, the loading lever is moved, possibly with an extension, until the load on the locking dog is released. At this point, the locking dog can be moved into a disengaged position and the winch is able to be unwound or paid out. A handwheel, with a foot brake if needed, can be used for unwinding the drum. The concern in this pay out operation is that at the point that the locking dog is disengaged the entire load will be carried by the operator through the loading lever and the extension. Under high loads this may be difficult to control for the operator as he moves to the handwheel.

It is an object of the present invention to minimize the drawbacks of the existing manual winches and to provide a simple easier method of unwinding. A further object of the present invention is to provide a system which can be retrofitted onto existing manual winches.

In the development of the present invention satisfying the above objects, the Applicants have created a manual winch with dual locking dogs described hereinafter. Winches with two locking dogs operating on a ratchet wheel have been known in the prior art. One common version is to form a double-tipped brake pawl such that one end or the other end of the brake pawl, i.e., either of the two locking dogs is alternately engaged with the ratchet wheel. A ratchet wheel using this double dog technology is sold under the PNW-1000 manual ratchet. Another winch incorporating this design is the HD-100 and HD-300 of Fugi Seiko winch products. A separate two dog winch mechanism is to have dogs operating in opposite directions such that one of the dogs can be operated depending on in which direction the drum is being wound. Such a reverse dog assembly can be found in the Wintech spur gear series. A third type of winch utilizing two locking dogs is a W-100 barge connector winch manufactured by Blackburn. In this device, the two pawls are connected together by a linkage mechanism so that they alternatively engage the single gear. To some extent, in operation this is similar to the double-tipped brake pawl which pivots to selectively have one dog engage the wheel. The deficiency in all of the prior art dual dogs is that there is no independent operation of the dogs. In the double-tipped device and the Blackburn device, the dogs are connected such that only one of the dogs can be operated In the reverse dog configuration of Wintech, only one of the locking dogs can hold the load depending on the direction in which it is turning. This prior art does not solve the problems addressed with the present invention. There still remains a need in the industry for dual locking dogs where each locking dog is operated independently such that, selectively, either one, neither, or both can be biased towards and engaged position.

SUMMARY OF THE INVENTION

The objects of the present invention are achieved by a manual winch with dual locking dogs according to the present invention. The present invention is designed to be easily retrofitted into existing winches. The design of the present invention includes a housing supporting a rotatable drum upon which the cable is reeved. A pair of gears are attached to the drum with a locking dog that may be engaged with each gear, wherein the drum is prevented from unwinding with at least one locking dog engaged with a respective gear.

These and other advantages of the present invention will be clarified in the description of the preferred embodiments wherein like reference numerals represent like elements throughout.

DESCRIPTION OF THE PREFERRED EMBODIMENTS

Figure 1:
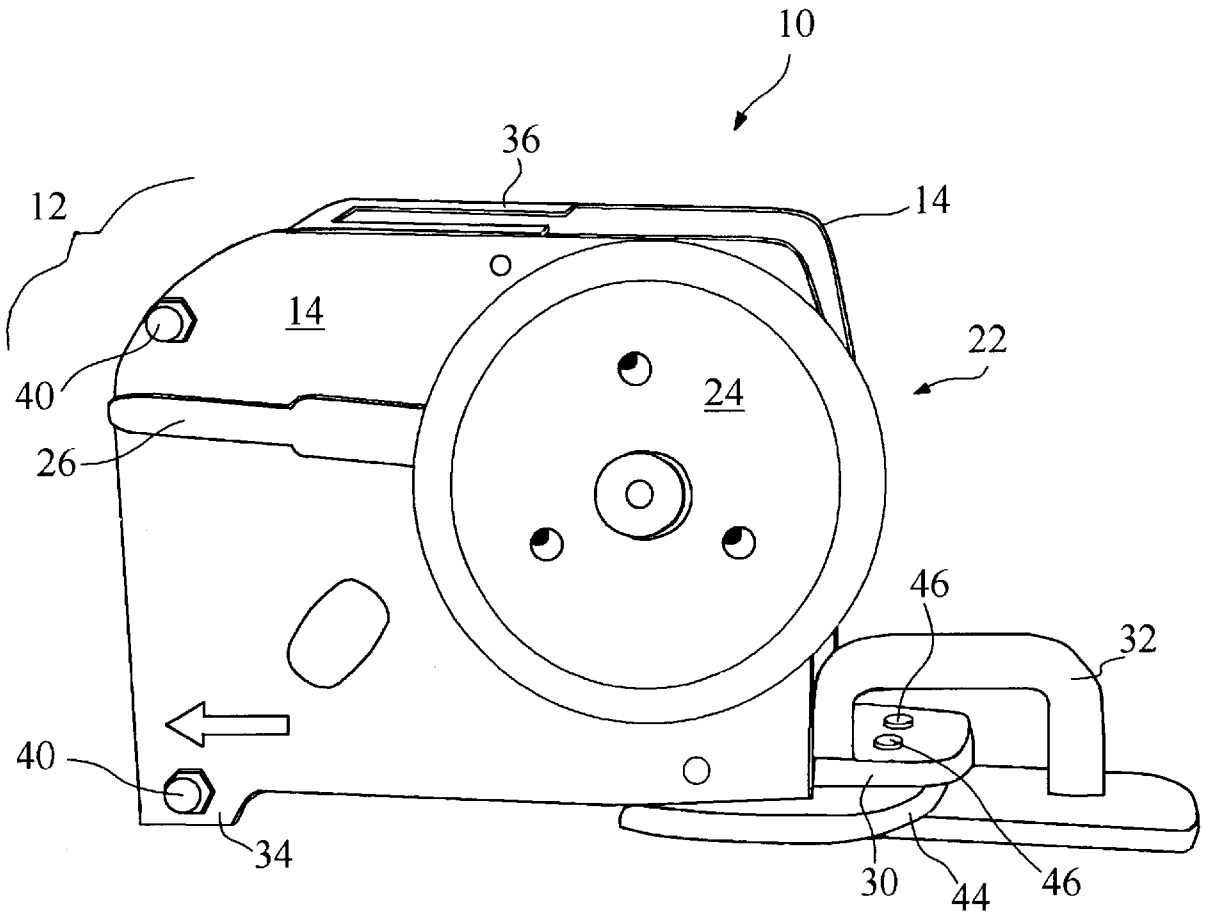
FIGS. 1–3 are perspective views illustrate a manual winch according to a first embodiment of the present invention.
Figure 2:
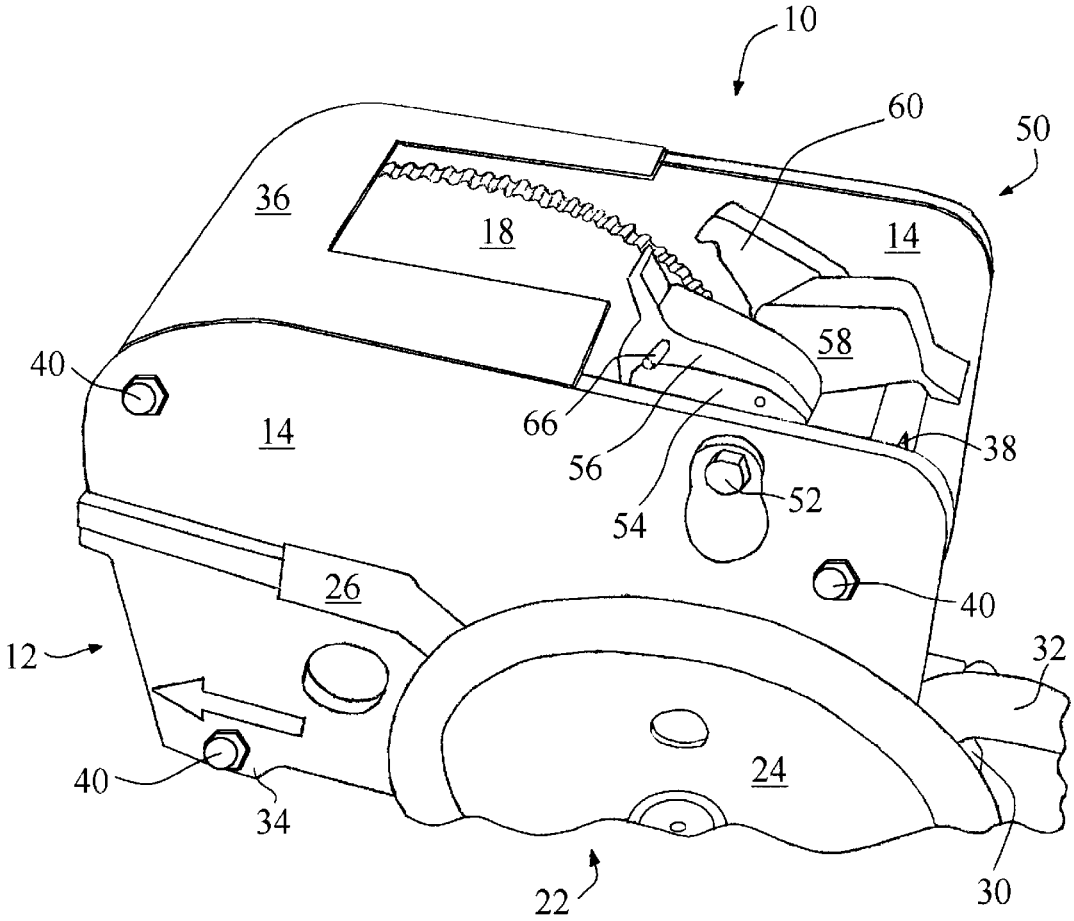
Figure 3:
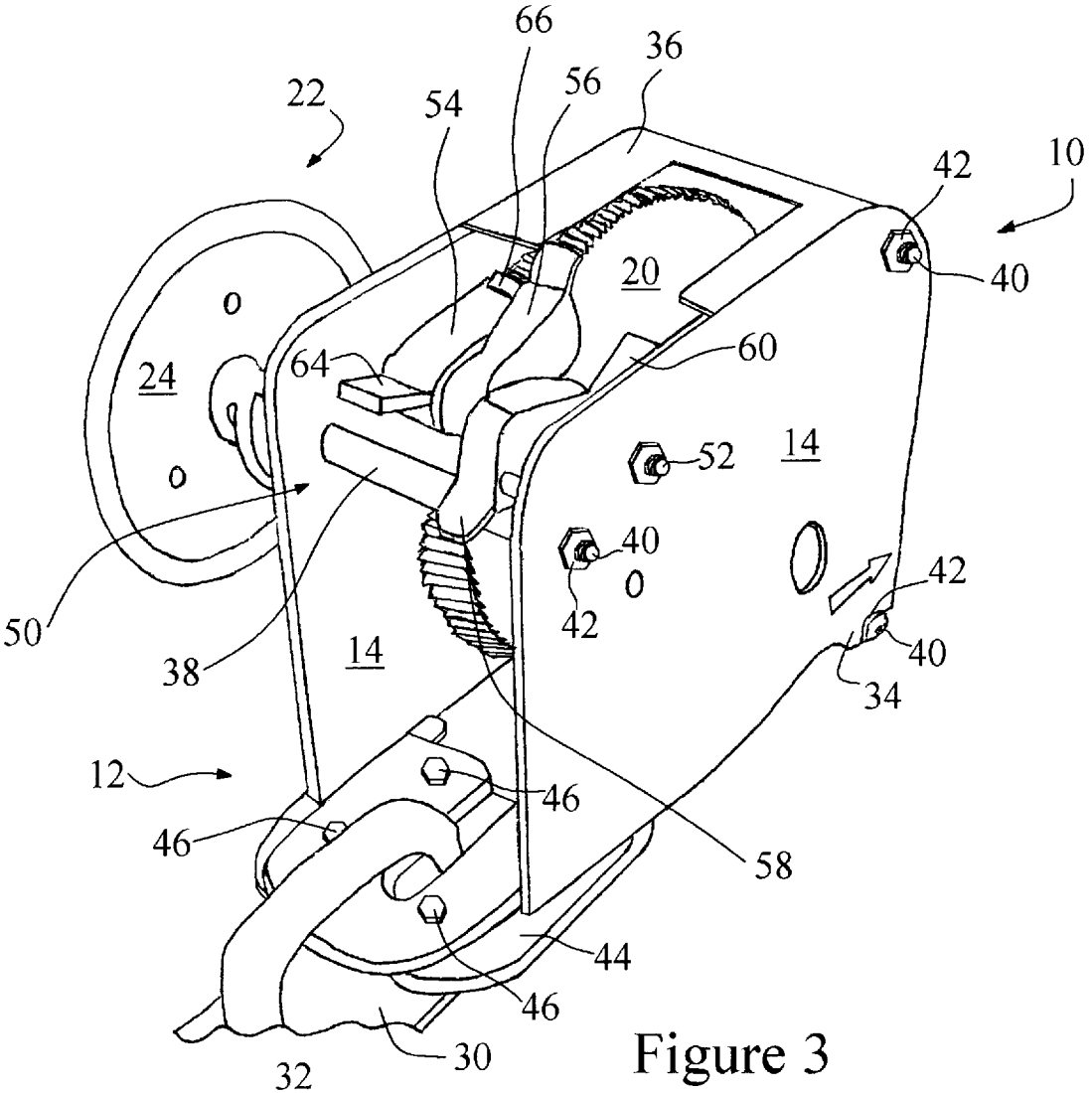
Figure 4:
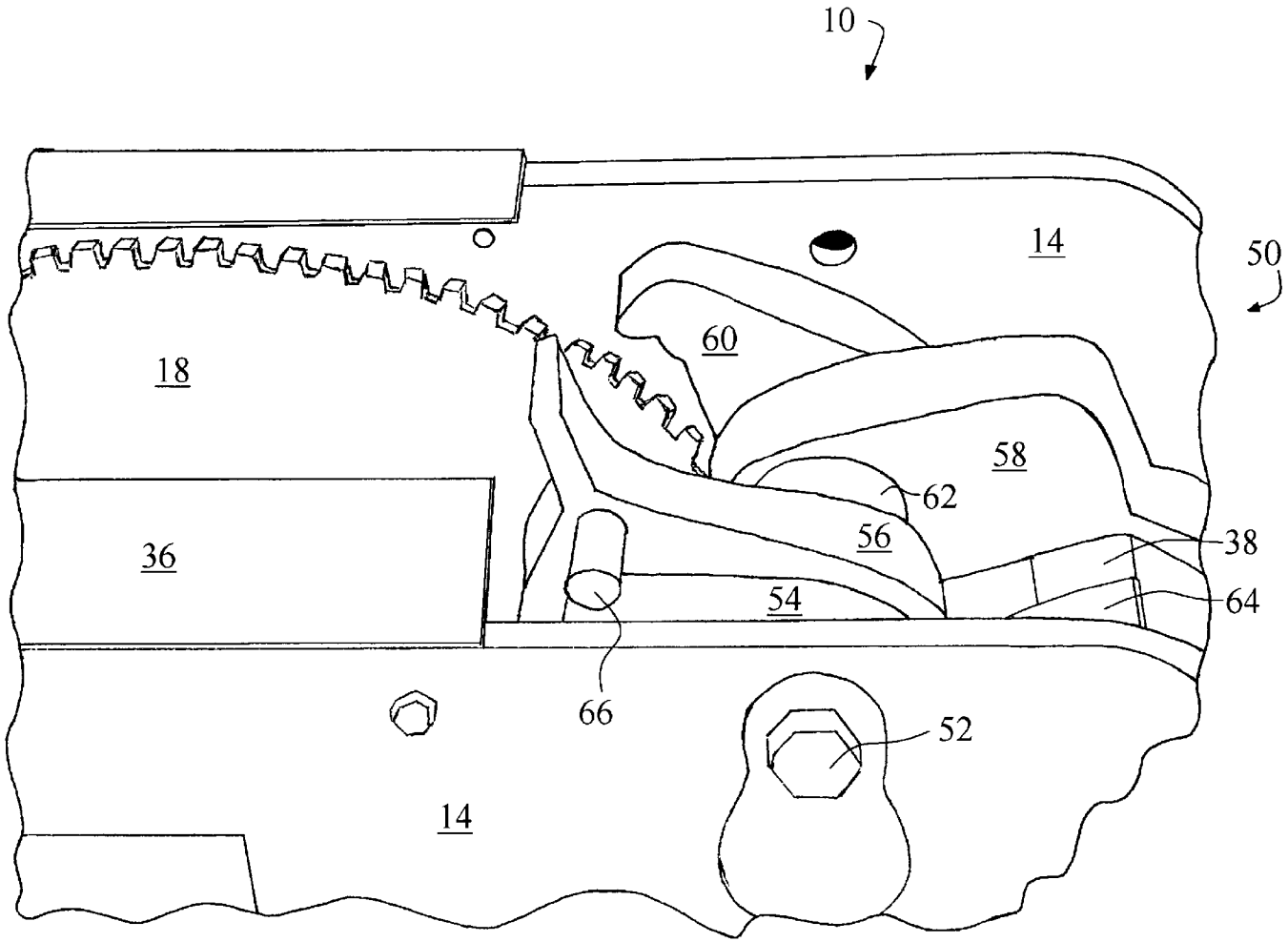
FIGS. 4–6 are perspective views illustrating the dual locking dogs of the manual winch illustrated in FIGS. 1–3.
Figure 5:
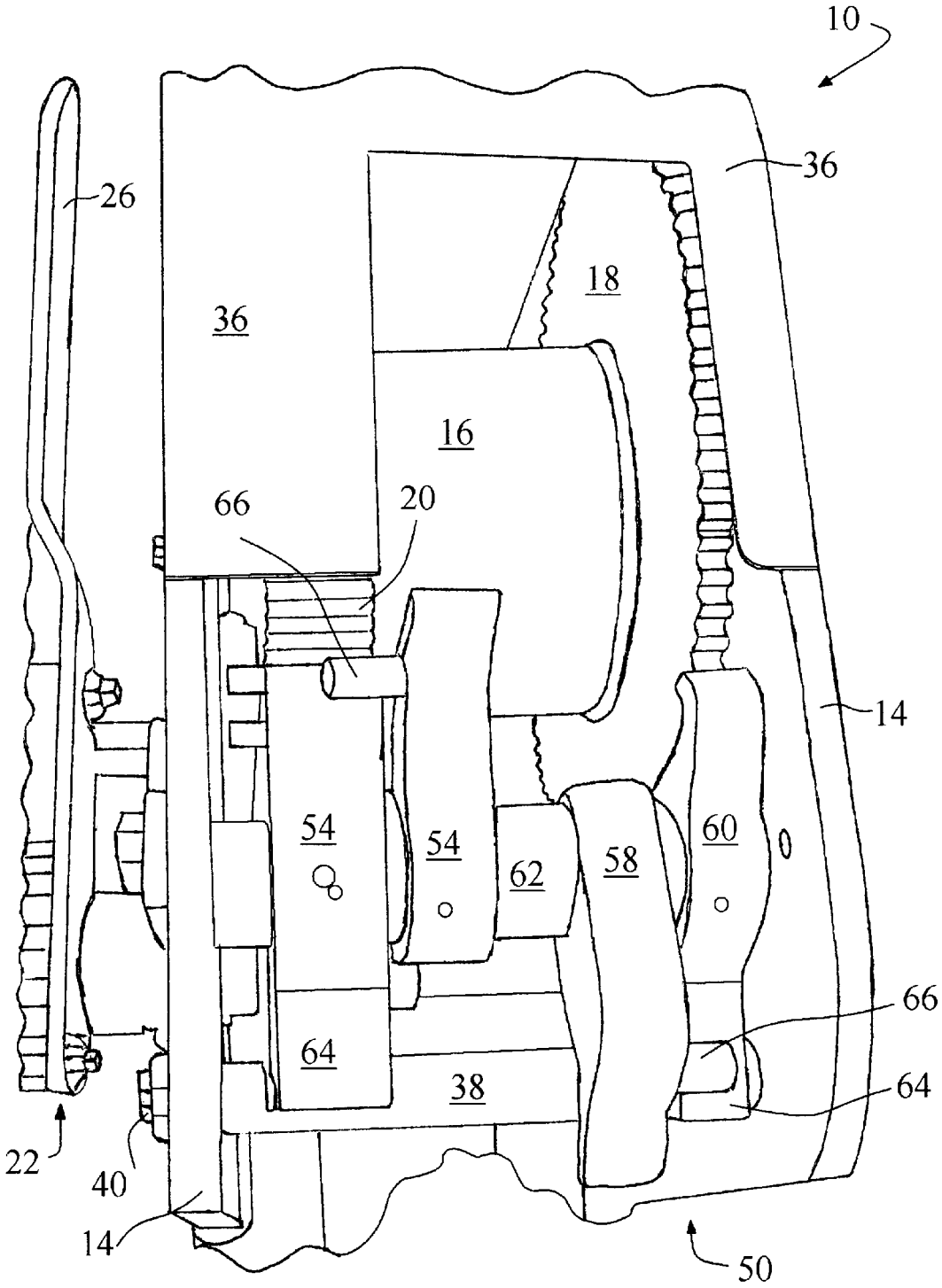
Figure 6:
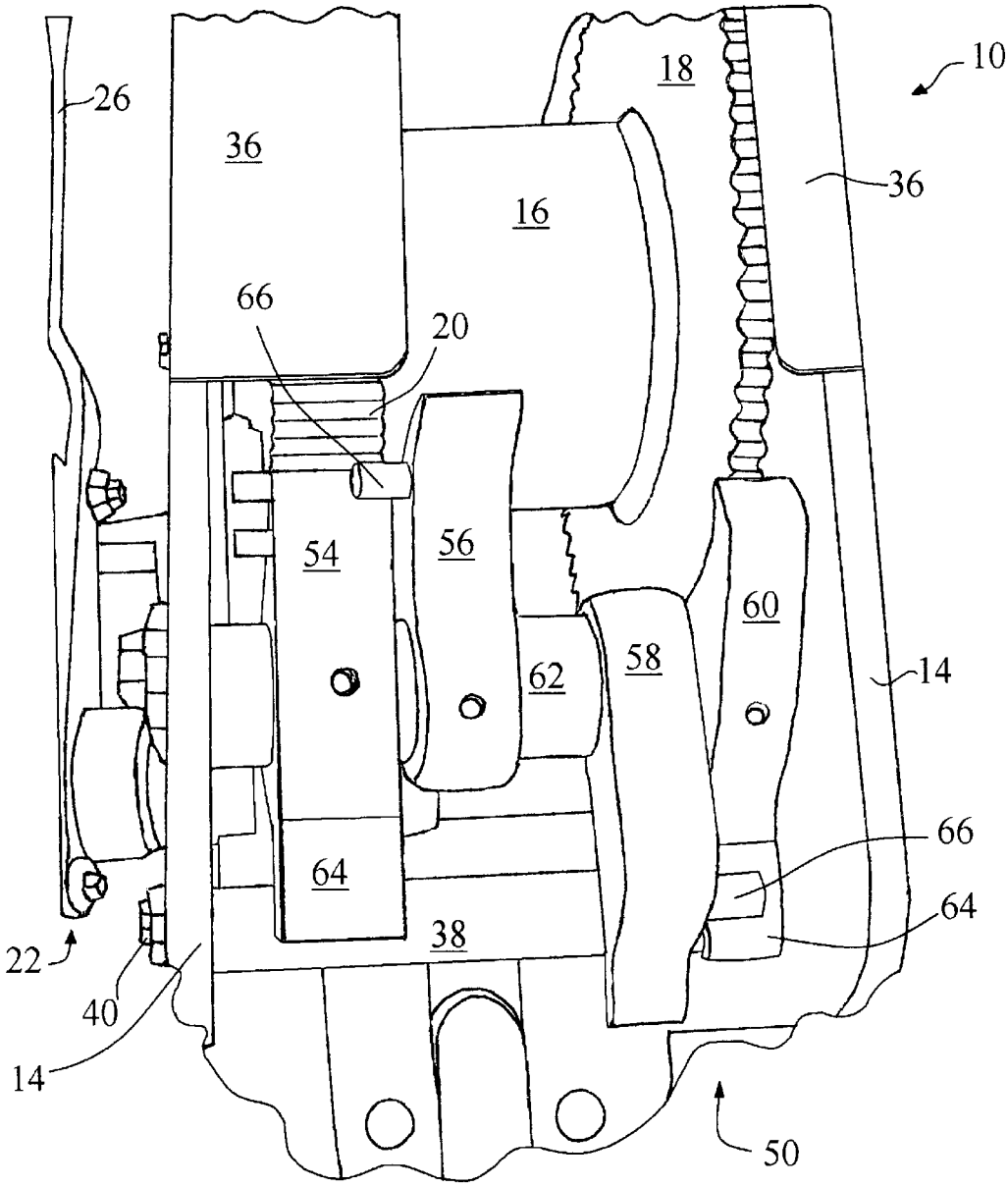
Figure 7:
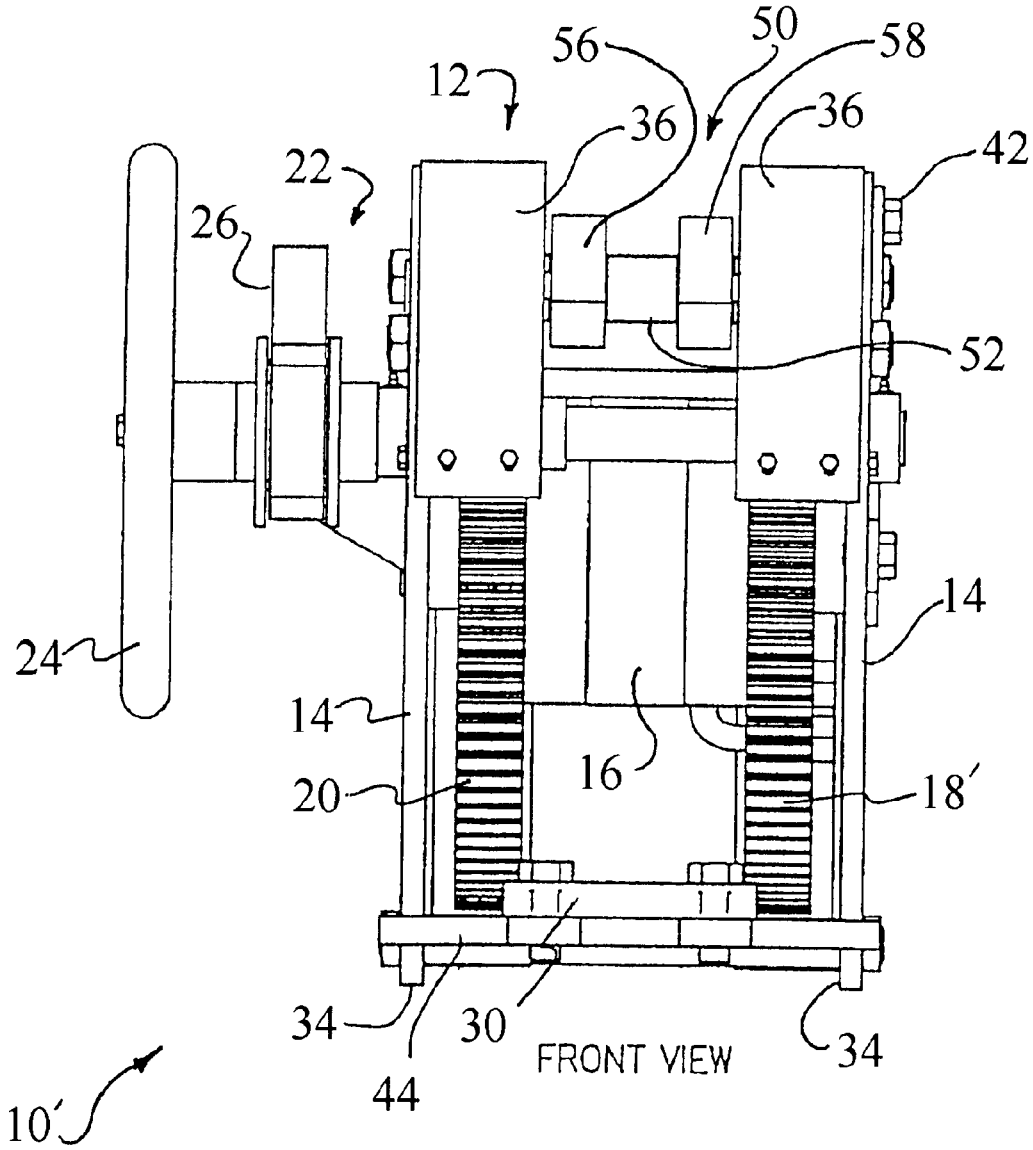
FIG. 7 is a front view illustrating a manual winch according to a second embodiment of the present invention.
Figure 8:
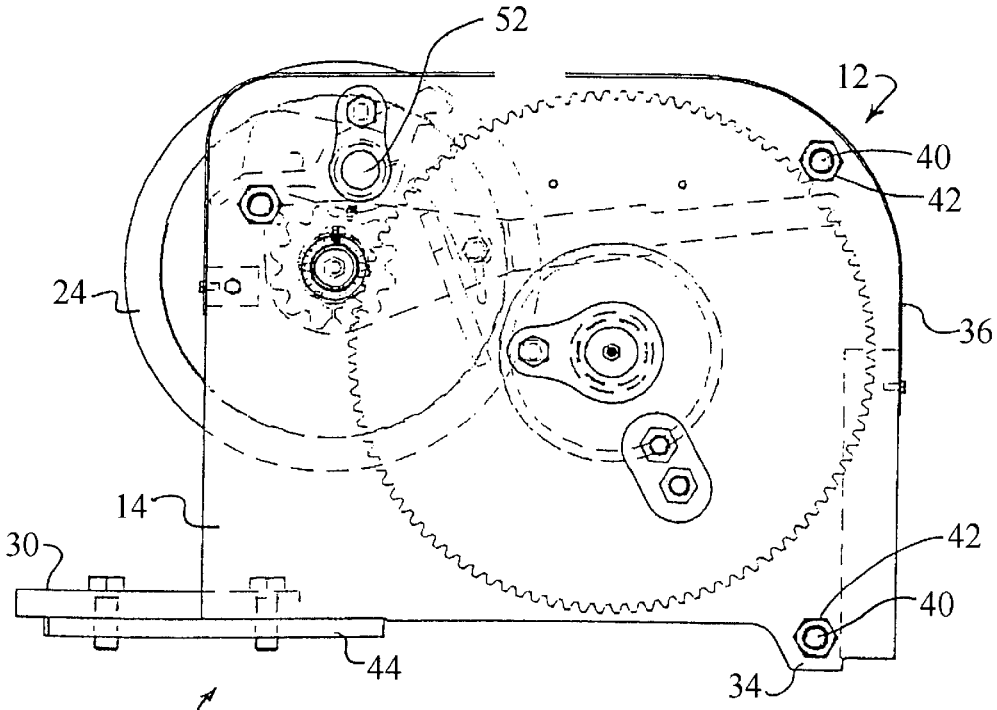
FIG. 8 is a side view illustrating the manual winch illustrated in FIG. 7.
Figure 9:
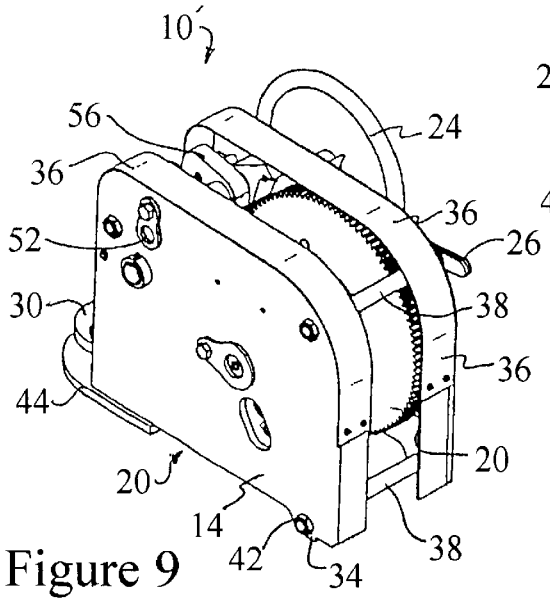
FIGS. 9 and 10 are perspective views of the manual winch illustrated in FIG. 7.
Figure 10:
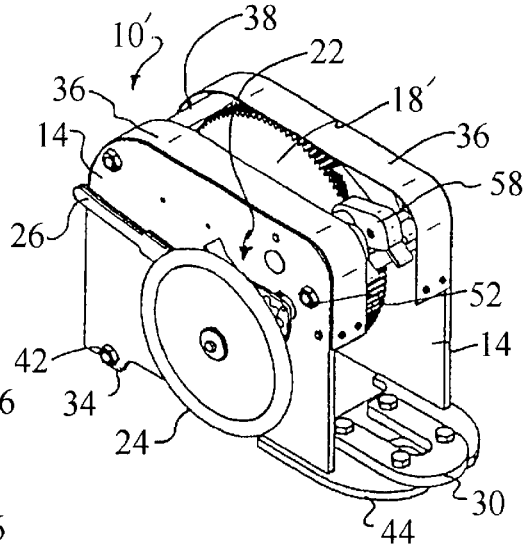

FIGS. 1–3 illustrate a winch 10 of the present invention. The winch 10 includes a housing 12 and a pair of spaced side plates 14 surrounding a rotatable spool assembly. The rotatable spool assembly is rotatably supported between the side plates 14 and includes a drum 16, a load release gear 18 on one side of the drum 16 and a controlling gear 20 on the other side of the drum 16. A control assembly 22 is supported by the side plates 14 and engages with the gear 20 to rotate the drum 16 for spooling of a cable (not shown) thereon. The control assembly 22 extends through one side plate 14 and includes a handwheel 24 and an actuating or loading lever 26 which are used for manually operating the winch 10 as will be described. A swivel link 30 is attached to the housing 12 at a rear end of the winch 10 and pivotally attaches the winch 10 to a D-ring 32 of a boat deck or the like. A step or foot 34 is attached to the underside of each side plate 14 near a forward portion of the winch 10 to form a recess in a lower portion of the side plate 14. The recess cooperates with the open bottom construction of the winch which is described in greater detail in U.S. Pat. No. 5,947,450 which is incorporated herein by reference. A gear guard 36 is attached to at least one of the side plates 14. The gear guard 36 helps prevent the cable from interfering with or becoming wrapped behind the gears 18 and 20 and minimizes debris intrusion into the winch 10. The gear guard 36 includes a cutout portion in the center and does not extend far beyond the gearing for increased visibility of the operator. With the gear guard 36, the operator can see the cable on the drum 16 and the operation of the locking mechanism as will be described.

The manual swivel winch 10 includes the use of tubular spacers 38 for spacing the side plates 14 apart. A bolt 40 extends through the center of each spacer 38 through aligned holes in the opposed side plates 14 and is secured by nuts 42. One spacer 38 is in the upper front portion of the winch 10 and another is in the upper rear portion of the winch 10. The spacer 38 in the upper rear portion of the winch 10 also acts as a stop for elements of the locking mechanism as will be described. A third spacer 38 is provided in the lower rear portion of the winch 10. The swivel link 30 is attached to a base plate 44 by bolts 46 threaded into tapped holes 48 formed in the base plate 44. The base plate 44 is welded to the side plates 14 and is sized to maintain the substantially open bottom of the winch 10.

A foot brake may be attached to the side plate 14 through which the control assembly 22 extends. The foot brake would be adapted to frictionally engage the handwheel 24. The winch 10 of the present invention generally eliminates the need for the foot brake allowing the foot brake to be removed from retrofitted units. The removal of the foot brake in a retrofitted winch provides a more compact unit and minimizes the interference of the winch 10 with other elements or people in the vicinity.

In addition to the load release gear 18, the significant distinctions of the winch 10 of the present invention are in the locking mechanism 50 mounted on shaft 52 which extends between side plates 14. The locking mechanism 50 includes a loading locking dog 54, a first counterweight 56, a second counterweight 58 and a release locking dog 60 pivotably mounted on the shaft 52. A spacer 62 is provided for maintaining proper positioning of the components on the shaft 52. The load locking dog 54 is pivoted into engagement with the gear 20 and the release locking dog 60 is independently pivoted into engagement with the gear 18 in a locking direction. The engagement of either locking dog 54 or 60 with the respective gear 20 or 18 will prevent the drum 16 from unwinding, as known in the art.

Each locking dog 54 and 60 is independently pivoted out of engagement with the respective gear 18 or 20 in a release direction. Each locking dog 54 or 60 includes a stop 64 that engages the upper rear positioned spacer 38 to stop the rotation of the locking dog 54 or 60 in the release direction. Each counterweight 56 and 58 includes an engaging projection 66 adapted to engage the associated locking dog 54 or 60 selectively on opposite sides of the shaft 52. When the counterweight 56 or 58 engages the locking dog 54 or 60 on the gearing side of the shaft 52 the counterweight 56 or 58 will bias, through gravity, the locking dog 54 or 60 into engagement with the respective gear 18 or 20. When the counterweight 56 or 58 engages the locking dog 54 or 60 on the side of the shaft 52 away from the gearing and drum 16 the counterweight 56 or 58 will bias, through gravity, the locking dog 54 or 60 out of engagement with the respective gear 18 or 20 such that when the load on the locking dog 54 or 60 is released the locking dog 54 or 60 will pivot until the stop 64 abuts the spacer 38. Each counterweight 56 or 58 includes an ear 68 for easy manipulation of the counterweight 56 or 58 between the locking or releasing position by the operator.

Each gear 18 and 20 is substantially the same diameter with the same number of gear teeth or gear pitch. The gears 18 and 20 are rotationally offset from each other by one-half of a gear tooth such that only one locking dog 54 or 60 may be engaged at any given time. One alternative configuration would be to have the teeth of the gears 18 and 20 aligned and have the locking dogs 54 and 60 be configured (offset) such that they alternately engage the respective gear 18 or 20. The gear 18 is considered to be a release gear because it is formed thinner than the gear 20. Consequently, the gear 20 is intended to primarily hold the load of the winch 10 with the gear 18 generally only being used during releasing of the load on the drum 16 since the gear 20 is a more substantial gear better suited for maintaining the load of the winch 10 over extended periods of time. This design is for retrofitting the present invention with existing winches. It is expected that the gears 18 and 20 can be formed to be identical such that their respective operation is interchangeable. In other words, either gear could then be used for maintaining the load over time. This is illustrated in the embodiment shown in FIGS. 7–10 discussed below.

In operation, the winch 10 operates to provide a safe load release. Under load, the locking dog 54 will be engaged with gear 20 and will be receiving the load from the drum 16. In order to begin releasing the load the operator will move the counterweight 56 to the release position and move the counterweight 58 to the locking position. This movement will place a bias on locking dog 54 to the release position and a bias on locking dog 60 to the locking position. At this point, the locking dog 54 remains in the locked position due to the loading of the drum 16 and the locking dog 60 is not engaged with the gear 18 due to the offset positioning of the gear teeth between gears 18 and 20. Essentially, the locking dog 60 is resting against the top of a gear tooth of the gear 18. The operator can now move the loading lever 26, possibly with an extension bar, to begin releasing the load from the locking dog 54. As the load is transferred, at least momentarily, to the loading lever 26 the force of the counterweight 56 will move the locking dog 54 to the release position out of engagement with the gear 20. Once the locking dog 54 is pivoted out of engagement with the gear 20 the operator can begin moving the loading lever 26 in the opposite direction to begin releasing the load. The loading lever 26 will only move a relatively small distance before the locking dog 60 engages with the gear 18. The rotation of the loading lever 26 is essentially equal to one half of one gear tooth. With the locking dog 60 engaged the load will be transferred from the loading lever to the locking dog 60. This process is then repeated with the operation of the locking dogs reversed.

Specifically, the operator will now move the counterweight 58 to the release position and move the counterweight 56 to the locking position. This movement will place a bias on locking dog 60 to the release position and a bias on locking dog 54 to the locking position. Now the locking dog 60 remains in the locked position due to the loading of the drum 16 and the locking dog 54 is not engaged with the gear 20 because the locking dog 54 is now resting against the top of a gear tooth of the gear 20. The operator can again move the loading lever 26 to release the load from the locking dog 60. As the load is transferred, at least momentarily, to the loading lever 26 the force of the counterweight 58 will move the locking dog 60 to the release position out of engagement with the gear 18. With the locking dog 60 out of engagement with the gear 20, the operator can begin moving the loading lever 26 in the opposite direction to begin releasing the load. The loading lever 26 will only move a relatively small distance before the locking dog 54 engages with the gear 20. The rotation of the loading lever 26 is essentially equal to one half of one gear tooth. With the locking dog 54 engaged, the load will be transferred from the loading lever 26 to the locking dog 54.

The above process can be repeated as needed until the tension on the drum is reduced to a level, which the operator can easily manage on the hand wheel 24. The tension on the drum 16 drops significantly with relatively minimal movement of the drum. Essentially, a rotational movement of one to two teeth (i.e. two to four cycles of loading on the loading lever 26) of one gear 18 or 20 in the release direction is sufficient to reduce the load on the drum 16 to a level that can be safely handled by the operator through the use of the handwheel 24 alone. At this point, both locking dogs 54 and 60 are moved to the release position, and the drum 16 is operated through the handwheel 24.

The winch 10 also provides for a higher tension to be placed on the drum 16 by the operator. For loading, the handwheel 24 is used until the tension on the drum 16 becomes too high for the operator to easily handle. At this point, both counterweights 56 and 58 are moved to the locking position. One locking dog 54 or 60 will engage with its respective gear 18 or 20 and hold the load. At this point, the operator may use the loading lever 26, possibly with an extension bar, to further rotate the drum 16. The operator need only rotate the drum for one half of a tooth of the gears 18 and 20, since at this point the other locking dog 54 or 60 will be engaged with its respective gear 18 or 20. The first locking dog 54 or 60 to engage will of course no longer be engaged with it respective gear 18 or 20. This operation differs from the conventional loading technique essentially only in that the rotation required by the operator to move to the next locking position, which is at a correspondingly higher tension, is one half of the conventional winch 10. This results in a higher loading limit for the operator. In a conventional winch, the winch is at the operator's loading limit when the operator can no longer move the drum for a full gear tooth. The winch 10 of the present invention is at the operators loading limit when the operator can no longer move the drum 16 for one half of a gear tooth. Additionally, this advantage is likely to lead to greater than a one-half tooth increase in the loading position. For comparison, in a conventional winch the loading limit is where the operator cannot move the drum one full gear tooth. However, the operator may be able to move one full gear tooth, or more, if only one half gear tooth rotations are required, as in the winch 10. As noted above in the winch 10 as illustrated, the final loading should be held on gear 20 and locking dog 54 since gear 20 is more substantial. If gears 18 and 20 are formed identical then either may be used to hold the final loading as in the embodiment shown in FIGS. 7–10 discussed below.

The present invention is easily retrofitted into existing winches, such as those sold by W. W. Patterson Co. of Pittsburgh, Pa. and illustrated in U.S. Pat. No. 5,947,450. The existing winches include a housing 12 having a pair of spaced side plates 14 surrounding a rotatable spool assembly, a control assembly 22 including a handwheel 24, a loading lever 26 and tubular spacers 38 with bolts 40 and nuts 42 essentially as described above in connection with the winch 10.

The retrofitting process begins by pulling off the hand wheel 24. The removal of the hand wheel 24 allows room for subsequent retrofitting. Next, the shaft 52 containing the original locking dog and counterweight is removed together with the original counterweight and locking dog. The original shrouding and the spacer 38 in the upper forward portion of the winch is removed. The shaft 52 for the original drum 16 is removed which allows the original drum 16 to be removed through the top of the winch 10. The drum 16 with gears 18 and 20 can then be positioned between the side plates 14 and the drum shaft 52 reinserted. The spacer 38 can then be replaced. The locking dog 54, counterweight 56, spacer 62, counter weight 58 and locking dog 60 forming the locking mechanism 50 can be installed on the shaft 52. The shaft 52 may be a new shaft to better accept the specific components of the locking mechanism 50, however, the old shaft 52 could also be used. Finally, the gear guard 36 is attached in place of the old shrouding, and the handwheel 24 is reattached. The retrofitted winch 10 is now complete. A foot brake may be removed from retrofitted units. As noted above, the removal of the foot brake in a retrofitted winch 10 provides a more compact unit and minimizes the interference of the winch 10 with other elements or people in the vicinity.

FIGS. 7–10 illustrate a manual winch 10' according to another embodiment of the present invention. The winch 10' is essentially the same as the winch 10 discussed above except that the load release gear 18' is designed essentially the same as the controlling gear 20 such that either can take up the load. As discussed above, the teeth of the gears 18 may be offset one-half of the gear tooth from the teeth of gears 20. Alternatively, the position of the engaging dogs may be offset as discussed above. The winch 10' may be retrofitted with existing winches. In retrofitting existing winches, real capacity may be lost due to the increase in thickness of the gear 18'. Real capacity is not an issue in non-retrofitted winches 10' since the side plates can be appropriately positioned to accommodate the desired reel capacity with the relatively thicker gear 18'.

Figure 11:
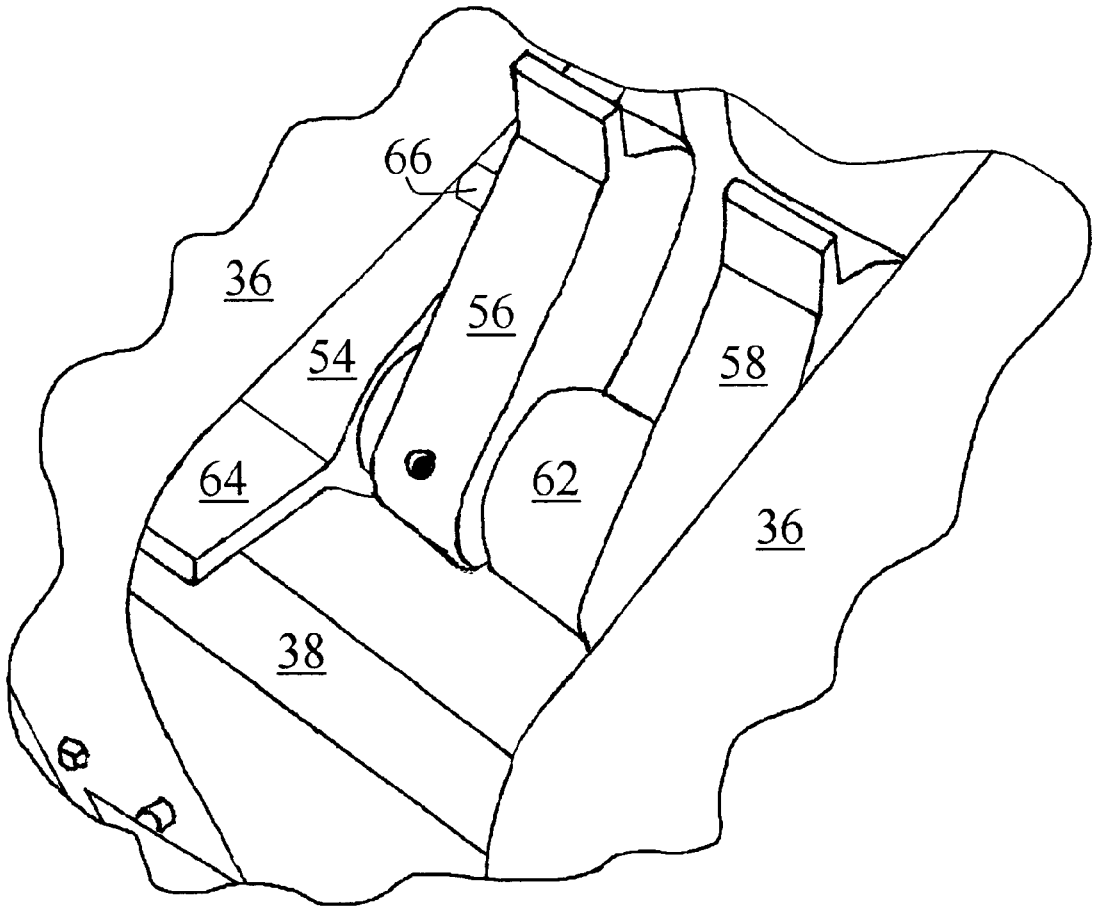
FIGS. 11–13 are perspective views of an operators perspective of the manual winch according to the present invention incorporating visual engagement indicators.
Figure 12:
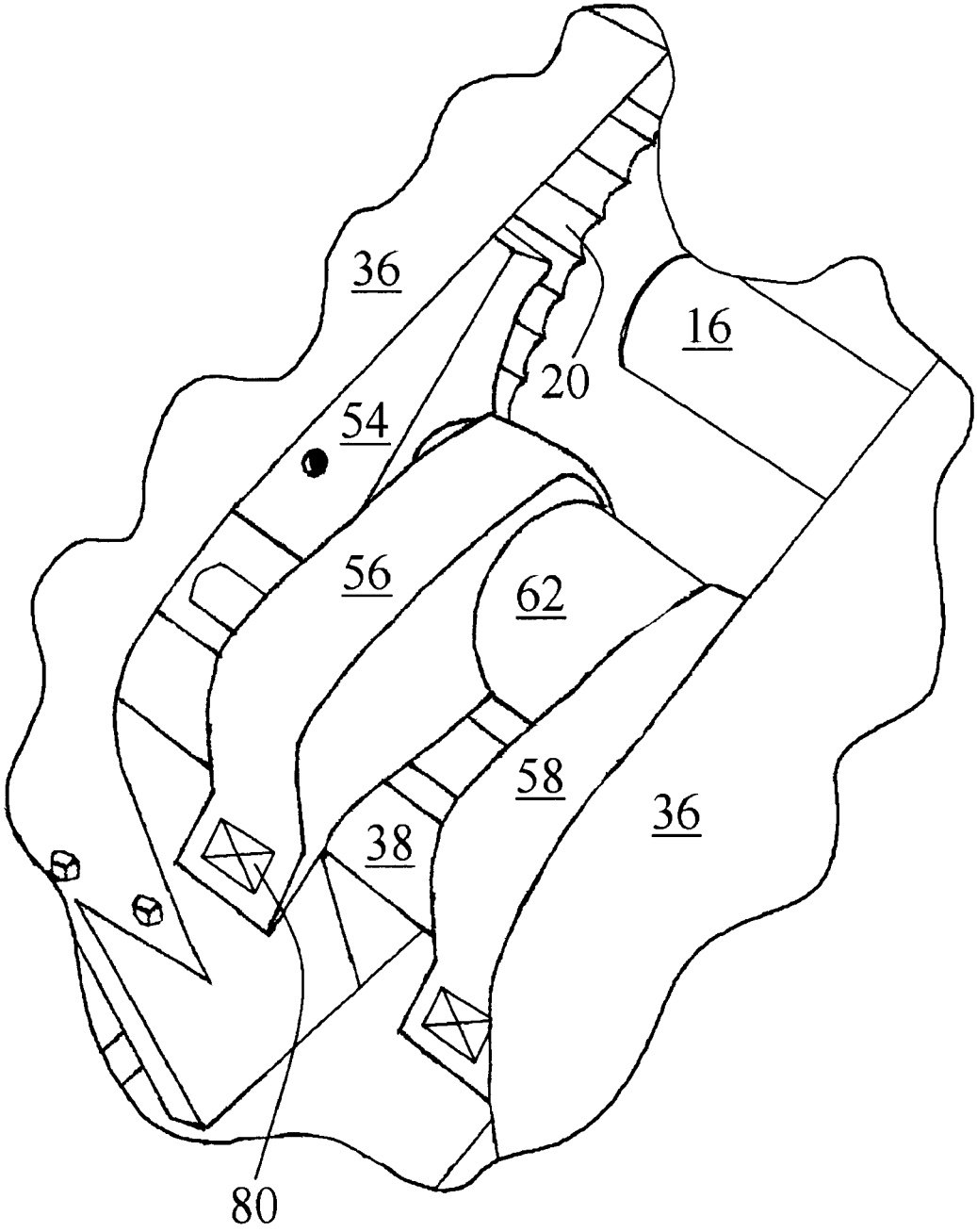
Figure 13:
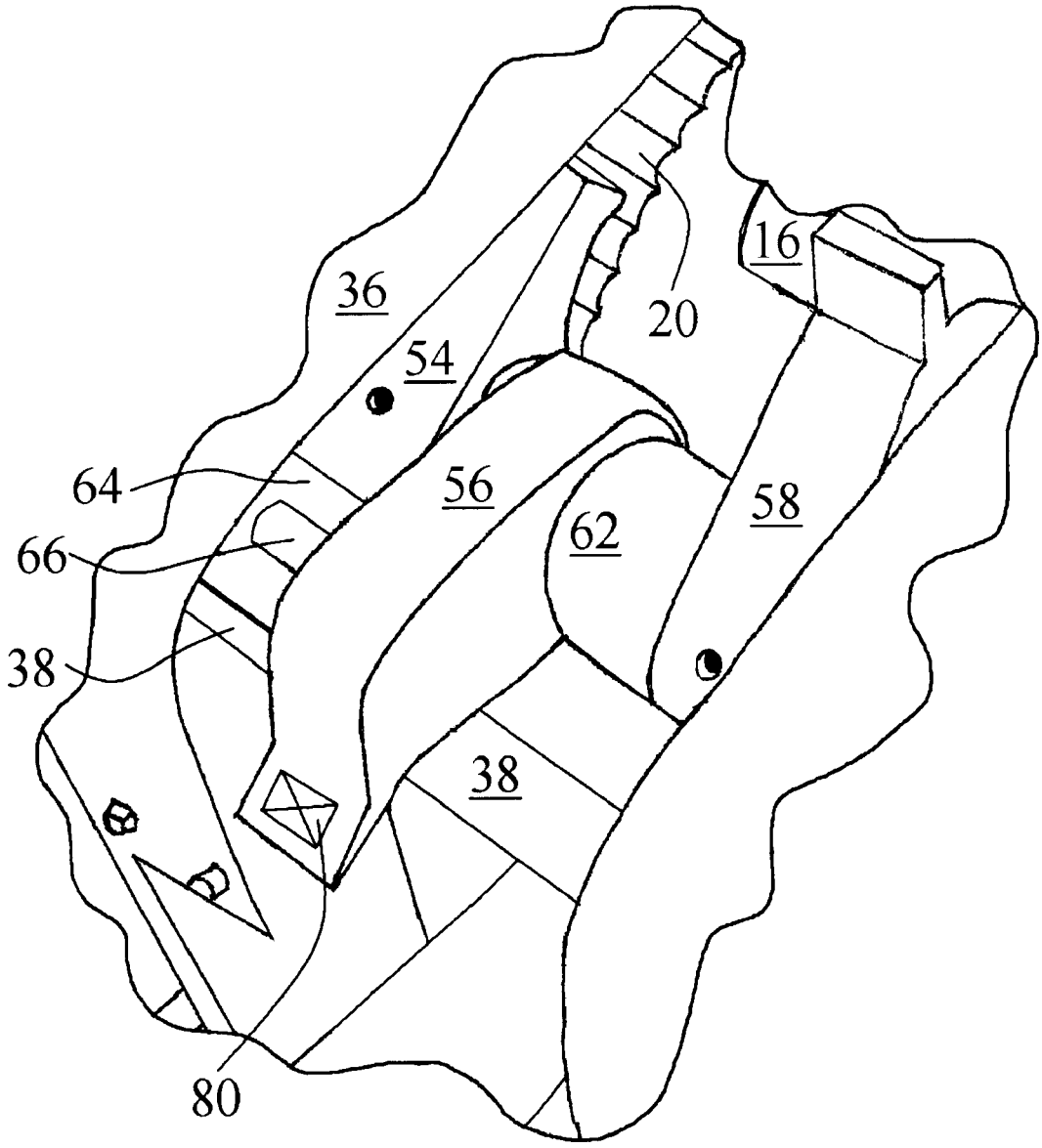
Figure 14:
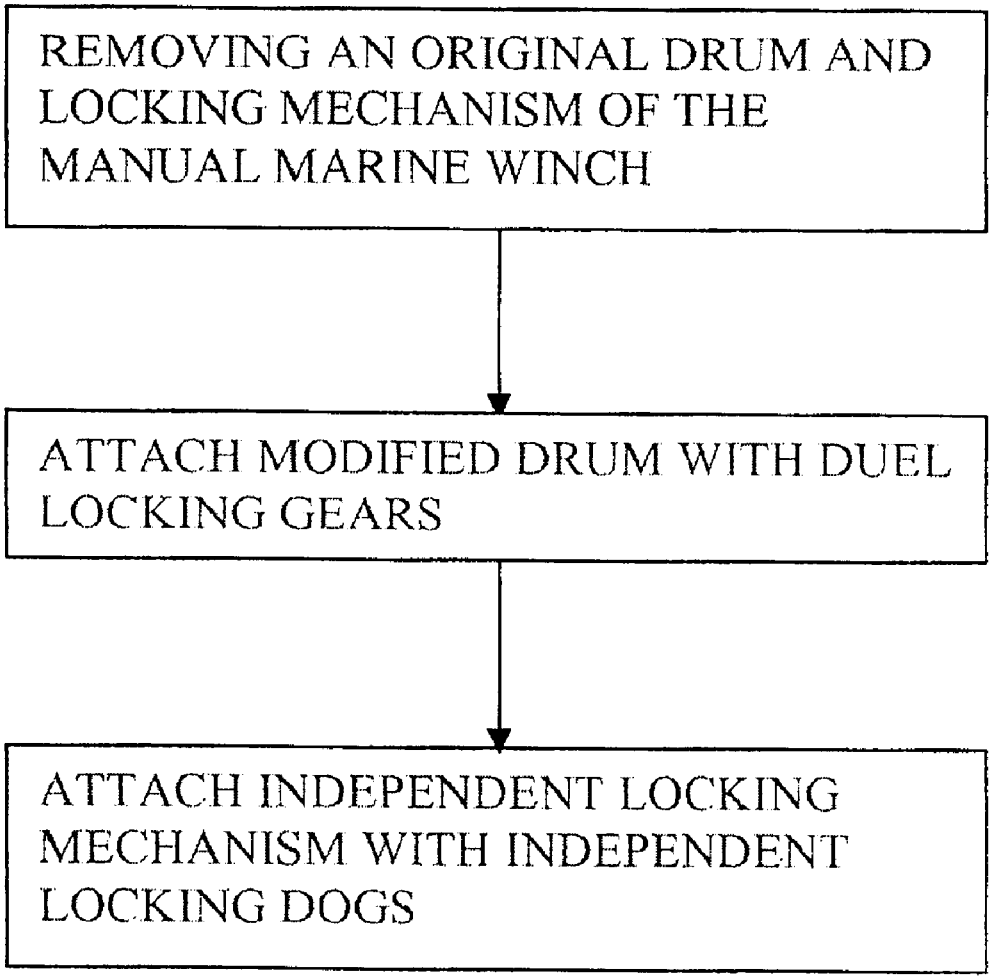
FIG. 14 is a schematic flow chart of the method of retrofitting a manual winch in accordance with the present invention.

FIGS. 11–13 illustrate another feature which can be incorporated into the winch 10 or 10' according to the present invention. This feature is a visual indicating mechanism to assist the operator and quickly identify the status of the locking dogs 54 and 60. Specifically, the visual indicating mechanism is in the form of a visual indicator 80 mounted on at least one side of each counterweight 56 and 58. The indicator can be easily formed as a color-coded attached plaque, writing or some other easily identifiable visual indication. Color-coding, text, symbols and combinations thereof are all excellent examples to assist in training the operator and quickly identifying to the operator the status. As evidenced in FIGS. 11–13, the visual indicators 80 are visible to the operator in the operator's position when the associated counterweight 56 or 58 is biasing the associated locking dog 54 or 60 to the release position. For example, in FIG. 11, both counterweights 56 and 58 are forward, the visual indicators 80 are not visible, and both locking dogs 54 and 60 are being biased into the engaged position such that at least one of the dogs will be engaged, preventing the unwinding of the reel. FIG. 12 illustrates a position in which both counterweights 56 and 58 are positioned backward in a release position biasing both locking dogs 54 and 60 out of engagement with the respective gear 18–20. Forming the visual indicators 80 as red colored plaques is believed to be helpful such that when the operator sees two red plaques, it will provide a visual caution that both dogs are being biased to the release position. Finally, FIG. 13 illustrates one counterweight forward and one counterweight backward with the locking dog 54 biased to the release position and the locking dog 60 biased to the engaged position.

It will readily apparent that other visual indicating systems could be utilized, such as putting green plaques on the opposite side of the counterweights 54 and 56 or color-coding both sides of the counterweights. The present system is intended to be illustrative of one type of visual indicating mechanism which can be easily understood by the operator to provide visual feedback of the status for the winch 10 or 10'.

Although the present invention has been described with particularity herein, the scope of the present invention is not limited to the specific embodiment disclosed. The described embodiments are intended merely to be illustrative of the concepts of the present invention and not restrictive thereof. It will be apparent to those of ordinary skill in the art that various modifications may be made to the present invention without departing from the spirit and scope thereof. The scope of the present invention is defined in the appended claims and equivalents thereto.

What is claimed is:

1. A manual marine winch comprising:

a housing attached to a marine deck;

a drum rotatably supported on the housing, wherein a cable is adapted to be wound onto the drum;

a control assembly for manually operating the winch coupled to the drum for loading and releasing the load on the drum, the control assembly including a loading lever for assisting in loading and releasing the load on the drum;

a pair of locking gears attached to the drum; and a pair of locking dogs supported on the housing and separate from the control assembly, each locking dog independently selectively engaged with and disengaged from one of the pair of locking gears, wherein the drum is prevented from being unwound to release the load on the drum when one locking dog is engaged with a respective locking gear, and wherein the pair of locking dogs are independent of the control assembly whereby the locking dogs can be selectively engaged or disengaged with an associated locking gear.

2. The winch of claim 1 wherein each of the pair of locking gears have the same diameter and the same gear pitch.

3. The winch of claim 2 wherein each of the pair of locking gears are offset from each other by about one half of one gear tooth on one locking gear.

4. The winch of claim 1, further including a pair of independent counterweights, each counterweight visible to the operator and adapted to bias one of the pair of locking dogs towards an engagement with the associated locking gear in a first position and adapted to bias the locking dog towards disengagement with the associated locking gear in a second position, whereby the two positions of each counterweight provide a visual indicator to the operator which identifies the relative position of each locking dog.

5. The winch of claim 4, wherein only one of the pair of locking dogs is engagable with a respective locking gear at any given time.

6. The winch of claim 1, wherein each of the pair of locking dogs are independently pivotably mounted on a common mounting shaft.

7. The winch of claim 6, further including a pair of independently operated counterweights, each counterweight selectively engagable with one locking dog for selectively biasing the locking dog into engagement with the respective locking gear or out of engagement with the respective locking gear by positioning the counterweight in one of two positions.

8. The winch of claim 7, wherein each counterweight will selectively bias the associated locking dog out of engagement with the associated locking gear when the counterweight is pivoted away from the drum.

9. The winch of claim 7, wherein each counter weight is mounted independently on a common mounting shaft.

10. The winch of claim 7, further including a stop that abuts the locking dogs in a release position.

11. The winch of claim 1, further including a gear guard which allows visibility to the operator of the operation of the locking dogs.

12. A process of retrofitting a manual marine winch having a housing, a drum in the housing, a control assembly for loading and releasing the load on the drum, and a locking mechanism, the process comprising the steps of:

removing an original drum and locking mechanism of the manual marine winch;

attaching a modified drum to the manual marine winch, the modified drum including a pair of locking gears; and attaching a locking mechanism to the manual marine winch which is independent of the control assembly, wherein the locking mechanism includes a pair of locking dogs supported on a housing of the winch with each locking dog independently engagable with one locking gear of the drum, wherein the drum is prevented from being unwound when at least one locking dog is engaged with a respective gear.

13. The winch product made according to the process of claim 12.

* * * * *